US009540074B1

(12) United States Patent
Pigeon

(10) Patent No.: US 9,540,074 B1
(45) Date of Patent: Jan. 10, 2017

(54) DEVICES MOUNTED WITHIN AND/OR ON BOAT HULLS FOR MANIPULATING WAKESURF AND WAKEBOARD WAKES

(71) Applicant: TIGE BOATS, Abilene, TX (US)

(72) Inventor: Charles Frank Pigeon, Austin, TX (US)

(73) Assignee: Tige Boats, Inc., Abilene, TX (US)

( * ) Notice: Subject to any disclaimer, the term of this patent is extended or adjusted under 35 U.S.C. 154(b) by 0 days.

(21) Appl. No.: 14/671,611

(22) Filed: Mar. 27, 2015

Related U.S. Application Data

(60) Provisional application No. 61/971,191, filed on Mar. 27, 2014, provisional application No. 62/112,998, filed on Feb. 6, 2015.

(51) Int. Cl.

| | |
|---|---|
| ***B63B 1/22*** | (2006.01) |
| ***B63B 1/30*** | (2006.01) |
| ***B63B 13/00*** | (2006.01) |
| ***B63B 35/85*** | (2006.01) |
| ***B63B 1/28*** | (2006.01) |
| ***B63B 1/24*** | (2006.01) |
| ***B63B 1/26*** | (2006.01) |
| ***B63B 1/20*** | (2006.01) |

(52) U.S. Cl.
CPC . *B63B 1/22* (2013.01); *B63B 1/20* (2013.01); *B63B 1/242* (2013.01); *B63B 1/26* (2013.01); *B63B 1/286* (2013.01); *B63B 13/00* (2013.01); *B63B 35/85* (2013.01); *B63B 2035/855* (2013.01)

(58) Field of Classification Search
CPC ..... B63B 1/08; B63B 1/16; B63B 35/85; B63B 2001/045; B63B 1/38; B63B 35/73; B63B 3/38; B63B 35/816; B63B 1/04
USPC ..... 114/284, 285
See application file for complete search history.

(56) References Cited

U.S. PATENT DOCUMENTS 667,482 A * 2/1901 Albarda ..... B63H 25/44 114/145 R
3,159,134 A * 12/1964 Winnen ..... 440/43
(Continued)

OTHER PUBLICATIONS

Boat.com article dated Feb. 19, 2013, by Brett Becker, "The New Nautique Surf System: Surf on This!" accesed on the internet on Jul. 10, 2015 at http://features.boats.com/boat-content/2013/02/the-new-nautique-surf-system-surf-on-this/.*
(Continued)

*Primary Examiner* — Anthony Wiest
(74) *Attorney, Agent, or Firm* — Egan, Peterman, Enders & Huston LLP

(57) ABSTRACT

Wakesurf and wakeboard boats are provided which include a component positioned along and/or within the hull and an actuator coupled to the component for moving an end of the component outward from the hull and retracting the end of the component to be in proximity with the hull. In some embodiments, the component is spaced forward of a vertical plane comprising the forwardmost point of the transom. Methods for creating a wake behind a boat are also provided which include listing a boat to one side via a listing component disposed on such a side and moving a component disposed within or coupled to an exterior surface of the hull on the opposing side of the boat. The component is moved outwardly from the exterior surface of the hull such that a distal free end of the component is spaced from the exterior surface when the boat is listed.

19 Claims, 4 Drawing Sheets

(56) References Cited

U.S. PATENT DOCUMENTS

| | | | | |
|---|---|---|---|---|
| 4,928,613 | A * | 5/1990 | Rudolf | B63B 41/00 114/128 |
| 5,193,478 | A * | 3/1993 | Mardikian | B63H 25/44 114/145 A |
| 6,044,788 | A * | 4/2000 | Larson et al. | 114/253 |
| 6,105,527 | A | 8/2000 | Lochtefeld et al. | |
| 6,520,104 | B1 * | 2/2003 | Svensson | 114/144 R |
| 8,534,214 | B1 | 9/2013 | Gasper | |
| 8,539,897 | B1 | 9/2013 | Gasper et al. | |
| 8,578,873 | B2 | 11/2013 | Gasper et al. | |
| 8,833,286 | B1 | 9/2014 | Sheedy et al. | |

OTHER PUBLICATIONS

Wakeworld.com article dated Jan. 16, 2013, by David Williams, "First Look: Nautique Surf System" access on the internet on Jul. 10, 2015 at http://www.wakeworld.com/news/feature/first-look-nautique-surf-system.html.*

* cited by examiner

DEVICES MOUNTED WITHIN AND/OR ON BOAT HULLS FOR MANIPULATING WAKESURF AND WAKEBOARD WAKES

PRIORITY CLAIM

The present application claims priority to U.S. Provisional Application No. 61/971,191 filed Mar. 27, 2014 and U.S. Provisional Application No. 62/112,998 filed Feb. 6, 2015.

BACKGROUND OF THE INVENTION

1. Field of the Invention

This invention generally relates to boats and, more specifically, to boats having devices mounted within and/or on their hulls for listing and/or yawing the boats as well as manipulating wakesurf and wakeboard wakes behind the boats.

2. Description of the Related Art

The following descriptions and examples are not admitted to be prior art by virtue of their inclusion within this section.

Propeller-driven boats are often used for water sports, such as but not limited to water skiing, knee-boarding, wake boarding and wake surfing. The size and shape of desirable wakes and waves varies for each sport and is also dependent on the skill and preference of the person performing the sport. For example, most water sports are performed on boats with planing hulls, which when planed produce a relatively small and clean wake and, thus, are generally conducive for water skiing and knee boarding. For sports utilizing relative large wakes and waves, such as wake boarding and wake surfing, boats are operated at slow enough speeds so that they do not plane and are weighted to displace a relatively large amount of water, particularly at the boat stern to produce relatively large wakes and waves. In order to generate larger waves, a boat is often listed to one side by placing heavier and/or more ballasts on the noted side of the boat. The size and shape of a wake or wave generated by such techniques as well as the distance a wave is from the boat, however, are often limited and are particularly dependent on the amount and placement of ballasts in the boat as well as the design of the boat. It, therefore, would be desirable to develop boats and/or devices which may aid in manipulating wakesurf and wakeboard wakes.

SUMMARY OF THE INVENTION

The following description of various embodiments of boats and devices is not to be construed in any way as limiting the subject matter of the appended claims.

Embodiments of boats are provided which include an inboard engine and a ballast system, but are void of a sail mast and a sail for independently propelling the boats. In some embodiments, the boats include a component positioned along and/or within a sidewall of a hull of the boat such that at least a portion of the component is below a waterplane of the boat when the ballast system is engaged. In such cases, the boats further include an actuator coupled to the component for moving an end of the component outward from the sidewall of the hull and retracting the end of the component to be in proximity with the sidewall of the hull. In some of such embodiments, a backmost surface of the component is spaced forward of a vertical plane comprising the forwardmost point of a transom of the boat when the end of the component is moved outward from the sidewall. In addition or alternative to such cases, the boats may include a plate disposed within a recess along a bottom of a hull of the boat, wherein the plate is arranged such that it is spaced from a longitudinal axis of the boat. In such embodiments, the boats include an actuator coupled to the plate for moving a distal free end of the plate between a first position in which the plate is fully nested within the recess or is substantially flush a bottom surface of the hull adjacent the recess and a second position spaced under the hull. In such cases, the plate may be oriented such that a height of the plate extending from its lowermost edge to its uppermost edge is greater than a thickness of the plate extending from its backmost edge to its frontmost edge when the distal free end is spaced under the hull.

Embodiments of methods for creating a wake behind a boat are provided which include listing either a port side or starboard side of a boat via a listing component disposed on the listed side of the boat. In addition, the methods include moving a component disposed within or coupled to an exterior surface of a hull of the boat on a side of the boat that opposes the listed side of the boat. Moving the component includes moving the component outwardly from the exterior surface of the hull such that a distal free end of the component is spaced from the exterior surface when the boat is listed. In addition, the component may be oriented such that a backmost edge of the component is spaced forward from a vertical plane comprising a forward most point of a transom of the boat.

BRIEF DESCRIPTION OF THE DRAWINGS

Other objects and advantages of the invention will become apparent upon reading the following detailed description and upon reference to the accompanying drawings in which.

Figure 1:
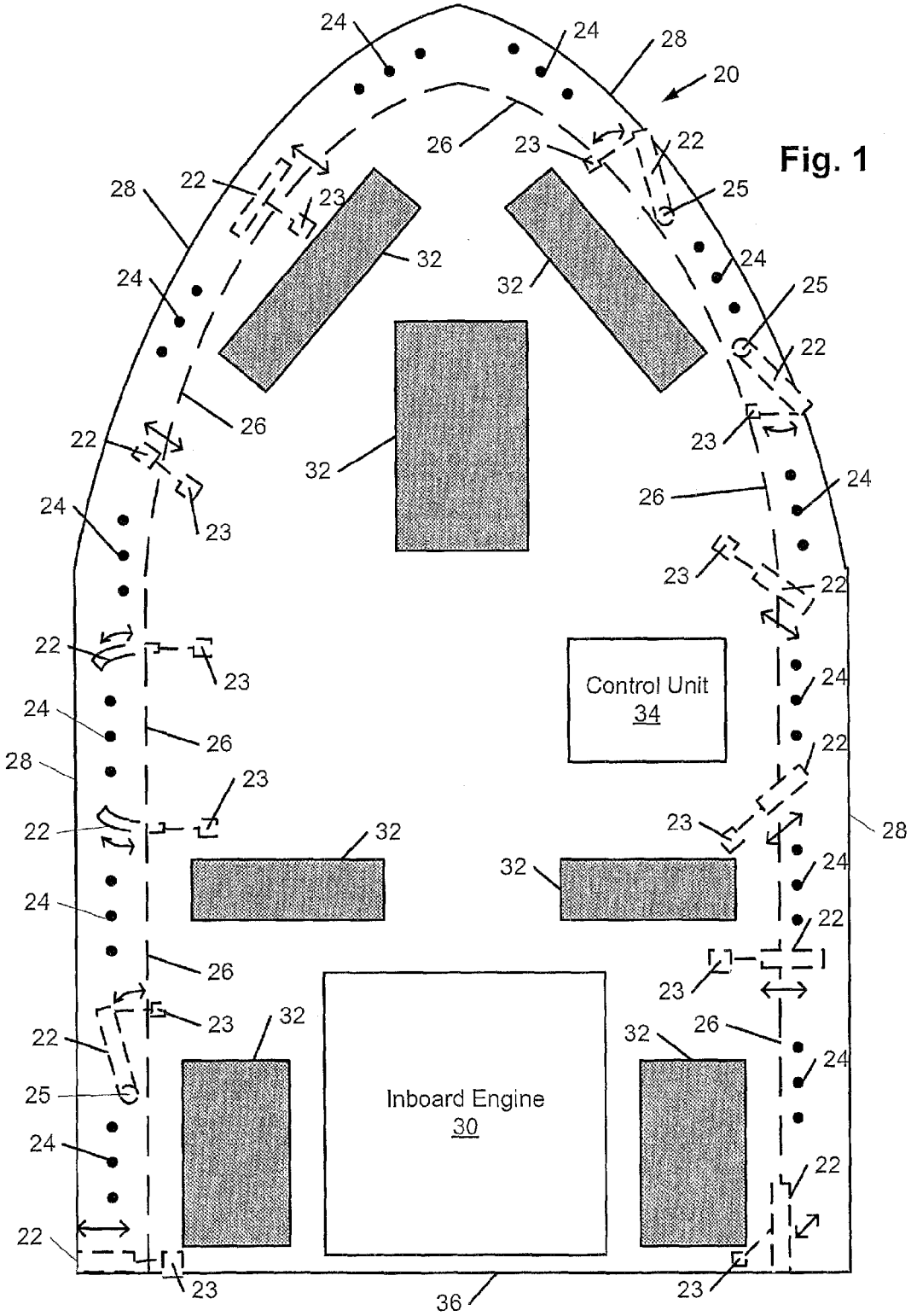
FIG. 1 is a top view of a boat having a variety of different actuated components positioned along or within sidewalls of the boat's hull.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Provided herein are boats having devices mounted within or along the boat's hull. Some of the devices cause the boats to yaw when deployed while others cause the boat to list when deployed. In some embodiments, a device may be configured to both list and yaw a boat. In any case, the devices may be used to manipulate wakesurf and wakeboard wakes generated by the boat. In some embodiments, the device may reduce and/or eliminate the use of ballasts to manipulate the wakesurf and/or wakeboard wake. As will be set forth in more detail below, the boats and actuated components devices described herein are not limited to the depictions in the drawings. Several other configurations of boats and devices may be considered. Furthermore, it is noted that the drawings are not necessarily drawn to scale.

In general, the devices described herein include a component positioned along or within a boat's hull and an actuator coupled to the component to move the component outward from the hull. More specifically, the components are pivotally coupled to an exterior surface of the hull and/or at least partially disposed within a recess of the hull and the actuators move the components outward from the hull and retract them in proximity to the hull's exterior surface and/or within the recess. As set forth in more detail below, the components may be positioned along or within a sidewall and/or a bottom of a boat's hull. The term "sidewall of a hull" as used herein refers to a portion of the hull that is angled less than 45° relative to a vertical axis when the boat is balanced in the water (i.e., the term "sidewall of a hull" refers to a portion of the hull that is considered closer to vertical than horizontal when the boat is balanced in the water). In contrast, the term "bottom of a hull" as used herein refers to a portion of the hull that is angled more than 45° relative to a vertical axis when the boat is balanced in the water (i.e., the term "bottom of a hull" refers to a portion of the hull that is considered closer to horizontal than vertical when the boat is balanced in the water). As set forth below, components positioned along or within a sidewall a boat's hull may generally cause the boat to yaw when deployed outward from the hull while components positioned along or within a bottom a boat's hull may generally cause the boat to list when deployed, but it is possible for a component to cause both movements. An example of a component which may cause both movements is described in more detail below in reference to FIGS. 7 and 8. It is noted other configurations may provide such dual functionality, including those which do not extend outward from both the sidewall and bottom of a boat's hull.

In any case, components considered herein may take many forms for causing a boat to yaw and/or list. Examples include plates, panels, rods, shafts and hydrofoils. Furthermore, the components considered herein may be specifically sized and/or oriented, have a particular surface configuration, have a particular shape, and/or be angled a particular degree relative to the hull to cause a boat to yaw and/or list. For example, it was found during the development of the devices disclosed herein that components orientated with their lengths (i.e., longest dimension) parallel with the stern of the boat or at an angle less than 45° relative to the stern of the boat are particularly effective for invoking either or both functionalities. In addition, it was found that rectangular and square plates oriented such that the height of the plate extending from its lowermost edge to its uppermost edge is greater than a thickness of the plate extending from its backmost edge (i.e., the edge closest to the stern of the boat) to its frontmost edge (i.e., the edge closest to the bow of the boat) are particularly effective for invoking either or both functionalities. Although the description and depictions of components in reference to FIGS. 1-12 emphasize such component configurations and orientations, it is noted that additional or alternative component configurations may be considered for invoking either or both functionalities. For example, a plate of any shape, including but not limited to a rectangles, triangles, circles, squares, ellipses, or any polygonal shape, may be employed. In addition, a plate may be straight, curved, bent, flat and/or include projections and/or depressions to help invoke either or both functionalities. Moreover, other forms of components, such as but not limited to those noted above, may be employed to facilitate either or both functionalities.

Regardless of their configuration and orientation, the components of the devices described herein may be made of any suitable material for withstanding the water pressure incurred by operation thereof. Fiberglass materials are preferred, but other materials may be considered. Furthermore, the components may be solid, hollow or a combination thereof. Moreover, any type of actuator, including but not limited to linear actuators, may be used. Electric actuators may be preferred since they are generally lighter in weight, but hydraulic or pneumatic actuators may be employed. Furthermore, an actuator may be attached to the component and the boat in any manner suitable. In some embodiments, the actuator may be disposed within the boat hull. In other cases, the actuator may be disposed exterior to the boat hull. In some cases, the actuator may be configured to move the component to a single designated position outward from the boat hull. In other embodiments, the actuator may be configured to move a component to a multiple predetermined positions. In yet other cases, an actuator may be programmed to vary the position of the component relative to a variable parameter of the boat, such as but not limited to speed, inclination, water pressure against the component and weight distribution in the boat.

In any case, it is noted that the actuated component devices described herein may be coupled to a controller and, in some embodiments, a user interface of the boat. In particular, the employment/movement of the actuated component devices described herein may be automated via circuitry and/or program instructions and, in some cases, activated via a user interface of the boat. In some cases, for safety precautions, the controller of the boat may be configured (i.e., via circuitry or program instructions) to restrict use of an actuated component device and/or retract the component when boat speed exceeds a particular threshold, such as but not limited to 20 mph.

As noted above, the actuated component devices described herein may be used to manipulate wakesurf and wakeboard wakes and, thus, the devices described herein are considered for boats used for wakesurfing and/or wakeboarding. As known to those skilled in the art, such boats are characterized by having an inboard engine and a ballast system which allows the stern to be weighted to manipulate wakes behind the boat for wakesurfing and wakeboarding, particularly at speeds less than approximately 20 mph. Although other types of boats, such as sailboats, include inboard engines and ballast systems, such boats are not used for wakesurfing and/or wakeboarding. To distinguish boats used for wakesurfing and/or wakeboarding from sailboats, the boats considered herein are described has being void of a sail mast and sail for independently propelling the boat. A further distinction is that the ballast systems in sailboats are not used or designed to weight the stern of sailboat to facilitate wakes behind the sailboat sufficient for wakesurfing and wakeboarding. In any case, the boats described herein may be of any size considered suitable for wakesurfing and/or wakeboarding. In some cases, boats with lengths less than 26 feet may be particularly suitable when the listing devices described herein are included in the boat. In particular, boats of 26 feet length or greater are generally not listed to one side for wakesurfing due to their girth, but rather make sizeable wakesurfing waves simply by running at low speeds and setting their trim tabs low.

In any case, the boats considered herein may be manufactured with one or more of the actuated component devices disclosed herein and/or may be retrofitted with one or more actuated component devices after manufacture. Moreover, the boats considered herein may include a factory ballast system and/or a ballast system added to the boat after manufacture. Either or both of such ballast systems may be above and/or below the floor of the boat. Moreover, the boats considered herein may include a direct drive or v-drive system layout. In any case, in order to prevent sinking the boat, the hull and/or the actuated component devices described herein are configured to prevent water from entering the hull. Various configurations may be employed, but in general, any component passing through the surface of the hull, whether it is in a recess or along the outermost exterior of the hull, is hermetically sealed to the hull. It is further noted that a recess in a hull as used herein may refer to an area of the hull in which the exterior surface of the hull extends inward such that the recess is bound by the surface of the hull. A recess in a hull may alternatively refer to a housing disposed within an opening of the hull, wherein the housing surrounds the actuated component and, in some cases, it associated actuator. In such cases, the housing includes a port arranged in alignment with the opening of the hull through which the component passes upon movement by the actuator. The portion of the housing surrounding the port is hermetically sealed to a surface of the hull around the hull's opening.

Turning to the drawings, FIG. 1 illustrates a top view of boat 20 having a variety of different actuated components 22 positioned along or within sidewalls of the boat's hull. The variety of different actuated components 22 are shown to depict the varying degree of sizes and shapes a component and an associated actuator may have, the varying positions a component and an associated actuator may be positioned along or within a boat's hull, and the varying directions of movement of a component relative to the boat's hull. Although a boat may include multiple actuated devices positioned along and/or within its starboard and port sidewalls, such as shown in FIG. 1, the boats described herein are not necessarily so limited. In particular, the boats described herein may include any number of actuated devices along and/or within its sidewalls, including a single actuated device along or within each of the starboard and port sidewalls or even a single actuated device along or within one of such sidewalls. Furthermore, the actuated devices may be located along and/or within any portion of the hull's sidewalls as denoted by the continuation dots 24 in FIG. 1. As such, the boats described herein should not be limited to the number or placement of actuated components shown in FIG. 1. It is noted continuation dots 24 are merely used to show that the actuated devices may be positioned along or within any portion of the hull's sidewalls and, thus, continuation dots 24 are not part of boat 20.

Moreover, the boats described herein are not necessarily limited to having a particular configuration of an actuated component along a particular position of a particular sidewall. Rather, any of the configurations depicted in FIG. 1 as well as those further described herein may be positioned along or within any portion of either of the hull's sidewalls. As such, the boats described herein are not limited to the relative locations of component configurations along and/or within the sidewalls of boat 20 depicted in FIG. 1. In some cases, a boat may include an actuated device of the same configuration on each of the port side and the starboard side of the boat. Further to such embodiments, the actuated devices may, in some cases, be positioned in substantially similar locations along the port and starboard sides relative to the stern and the longitudinal axis of the boat. In particular, such configuration and placement symmetry among two actuated devices on either side of the boat may make the manipulation of wakes behind the boat for regular or goofy riders more uniform. Such symmetry, however, is not required and, thus, the type, placement and/or number of actuated devices on either side of a boat may be different.

As noted above, the term "sidewall of the hull" as used herein refers to a portion of the hull that is angled less than 45° relative to a vertical axis when the boat is balanced in the water (i.e., the term "sidewall" refers to a portion of the hull that is considered closer to vertical than horizontal when the boat is balanced in the water). The depth and lateral dimension of a hull's sidewall varies among boat designs, but in boats used for wakesurfing and wakeboarding the sidewall of the hull is generally angled inward from the top of the hull to the bottom of the hull. As such, the top view of boat 20 in FIG. 1 illustrates lower edge 26 of its sidewall interior to top edge 28 of its sidewall. In addition, lower edge 26 is denoted as a dotted line since it is under the top view of the boat. As described in more detail below, the variety of different actuated components 22 depicted in FIG. 1 are positioned along or within sidewalls of the hull of boat 20 and move outward from the sidewalls via actuators coupled thereto. Thus, the variety of different actuated components 22 are shown at least partially between lower edge 26 and upper edge 28.

As shown in FIG. 1, each of actuated components 22 are coupled to a respective actuator 23, wherein the actuator is configured to move an end of the component outward from a from the sidewall of the hull and retract the end of the component to be in proximity with the sidewall of the hull. In some cases, an actuated component device may be pivotally coupled to a sidewall of the hull by hinge 25. In such embodiments, the associated actuator 23 is coupled to an inward surface of the component (i.e., the surface facing the sidewall of the hull) between hinge 25 and the end of the component opposing the hinge, including being directly coupled to the end of the component opposing the hinge. In some embodiments, an actuated component device may be at least partially disposed within a recess within a sidewall of the hull. Such recesses are not shown in FIG. 1 to simplify the drawings, specifically such that the different configurations of actuated components 22 may be emphasized. In such cases, the associated actuator 23 may be hinged within the recess or may be coupled to one end of the component to move an opposing distal free end of the component outward from the sidewall of the hull.

In general, actuated components 22 may be used to cause the boat to yaw when the component is moved outward from the sidewall of the hull. In particular, causing a boat to yaw via deployment of the actuated components described herein may increase the size and/or improve the quality of (make cleaner) a wakesurf or wakeboard wake generated by the boat and, thus, the actuated components described herein may in some cases be used to manipulate wakesurf and wakeboard wakes. As shown in FIG. 1, most of actuated components 22 and their associated actuators 23 may be configured such that a backmost surface of a respective component is spaced forward of a vertical plane comprising the forwardmost point of transom 36 when the component is moved outward from the sidewall of the hull. In general, transom 36 may be substantially vertical or may be angled inward or outward relative to a horizontal axis of the boat. The adaption to have a backmost surface of a component spaced forward of the transom when the component is moved outward from the sidewall of the hull may aid in yawing the boat without additionally and directly changing the water flow at a respective transom corner (i.e., the component may be used to yaw the boat, which in turn may affect wakesurf and wakeboard wakes behind the boat, but the extended component may not have substantial effect on the flow of water at a respective transom corner).

The adaptation may, in some embodiments, be facilitated by having an actuated component pivotally coupled to a sidewall of the hull at a position spaced from the transom and a component having a length which is shorter than the spacing from the transom. In some cases, an actuated component may be pivotally coupled to a sidewall of the hull at a position spaced at least approximately 6 inches and, in some embodiments, at least approximately 12 inches from the transom. In alternative embodiments, the adaptation may be facilitated by having an actuated component disposed within a recess that is spaced from the transom as is shown for most of actuated components 22 in FIG. 1. In some cases, an actuated component may be disposed within a recess that is spaced at least approximately 6 inches and, in some embodiments, at least approximately 12 inches from the transom.

In yet other embodiments, an actuated component may be coupled to the transom 36 but yet be configured with its associated actuator such that a backmost surface of the component is spaced forward of a vertical plane comprising the forwardmost point of the transom when the component is moved outward from the sidewall of the hull. An example configuration of a component and associated actuator meeting such criteria is shown in the back right hand side corner of boat 20 in FIG. 1. In particular, the component is disposed with a recess of the hull sidewall at transom 36 (i.e., the recess abuts the transom or, in other words, the recess is disposed within the hull sidewall and the transom) and the associated actuator is configured to move the component outward from the hull sidewall in a forward motion such that the backmost surface of the component is spaced forward the transom. Other configurations of components and associated actuators, however, may be considered to meet such criteria. In general, the closer the backmost surface of a component is to the transom when it is moved outward from the hull sidewall, the more affect it will have on changing the water flow at a respective transom corner. In order to minimize the effect of changing water flow at a respective transom corner, actuated components and their associated actuators may, in some cases, be configured such that a backmost surface of a respective component is spaced forward of a vertical plane comprising the forwardmost point of the transom by at least approximately 6 inches and, in some cases, by at least approximately 12 inches when the component is moved outward from the sidewall of the hull.

In yet other cases, a boat may include an actuated component and an associated actuator configured such that a backmost surface of the component is at or behind the transom when the component is moved outward from the sidewall of the hull. An example configuration of a component and associated actuator meeting such criteria is shown in the back left hand side corner of boat 20 in FIG. 1. In particular, the component is disposed with a recess of the hull sidewall at transom 36 (i.e., the recess abuts the transom or, in other words, the recess is disposed within the hull sidewall and the transom) and the associated actuator is configured to move the component outward from the hull sidewall at a substantially perpendicular angle from the hull sidewall. In other embodiments, the associate actuator may be configured to move the component outward from the hull sidewall backward of the transom. Other configurations of components and associated actuators may be considered such that a backmost surface of the component is at or behind the transom when the component is moved outward from the sidewall of the hull.

Regardless of the position and configuration of the component and its associated actuator relative to the transom, in embodiments in which the component is disposed within a recess, the component and/or the assembly of the component and its actuator may, in some cases, include overall width, length and/or depth dimensions substantially similar to the recess. The term "substantially similar" as used herein refers to variations of up to +/−3% of the stated number. In particular, it may be advantageous for the length and width of the component and/or the assembly of the component and its actuator to be substantially similar to a length and width of the recess such that gaps between sidewalls of the recess and the component are minimized. In addition or alternatively, the depth of the component and/or the assembly of the component and its actuator may, in some cases, be substantially similar to the depth of the recess such that the component may be substantially flush with surfaces of the hull adjacent to the recess when the component is not deployed. As used herein, the term "flush" refers to being even, level and/or forming the same plane, but does not necessitate surfaces be in contact with each other. In yet other cases, the component need not be substantially flush with surfaces of the hull adjacent to the recess when the component is not deployed. In particular, the component may be inset within the sidewall of the hull or may extend slightly (e.g., up to approximately 1 inch) beyond the sidewall of the hull when the component is not deployed.

In cases in which the component is substantially flush or extends slightly beyond the sidewall of the hull when the component is not deployed, the component may, in some embodiments, include a peripheral or overlying flap at its distal end. In some embodiments, the peripheral or overlying flap may be dimensionally configured such that when the component is not deployed the peripheral or overlying flap may be adjoined to the exterior surface of the hull with no exposed gaps of the recess. In particular, the peripheral or overlying flap may be dimensionally configured such that at least its outer fringe is against the sidewall of the hull when the component is not deployed and, in effect, the gaps between the component and the hull sidewall are covered. In some cases, the peripheral or overlying flap may be tapered toward its outer boundary such the interface of the peripheral or overlying flap and the sidewall of the hull is not substantially stepped. In yet other embodiments, the hull and/or a housing of the actuated component device forming the recess in the hull may include a sliding door to respectively cover the hull's opening or the housing port. In such cases, the boat may be configured to move the sliding door to open and close the hull's opening or housing port in response to user input and/or based on the deployment of the actuated component. In particular, the sliding plate may be moved to expose the hull's opening or housing port when requested by a user of the boat, particularly to enable use of the actuated component. In addition, the sliding plate may be moved to cover the hull's opening or housing port when requested by the user of the boat and/or when the boat exceeds a predetermined speed.

As shown in FIG. 1, boat 20 includes inboard engine 30, ballast system 32 and control unit 34. An example configuration of control unit 34 is shown and described in more detail below in reference to FIG. 13. In general, ballast system 32 is designed and used to weigh the stern of boat 20 to facilitate wakes sufficient for wakesurfing and wakeboarding. Ballast system 32 may include a factory ballast system and/or a ballast system added to the boat after manufacture. Furthermore, the ballasts of ballast system 32 may be above and/or below the floor of boat 20. It is noted that the layout of inboard engine 30, ballast system 32 and control unit 34 in FIG. 1 is exemplary and other layout configurations may be considered. For example, boat 10 may alternatively include a direct drive system layout. Furthermore, control unit 34 may be arranged in any location within boat 20. Moreover, ballast system 32 may include more or less ballasts and/or one or more of the ballasts shown in FIG. 1 may be arranged at other locations in boat 20.

Figure 2:
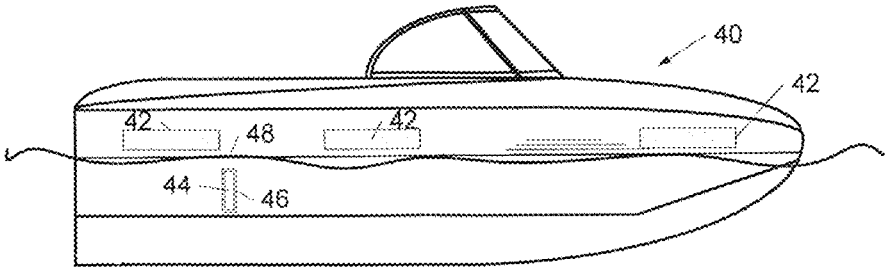
FIG. 2 is a side view of a boat with its ballast system engaged and an actuated component positioned within a recess in a sidewall of the boat's hull.
Figure 3:
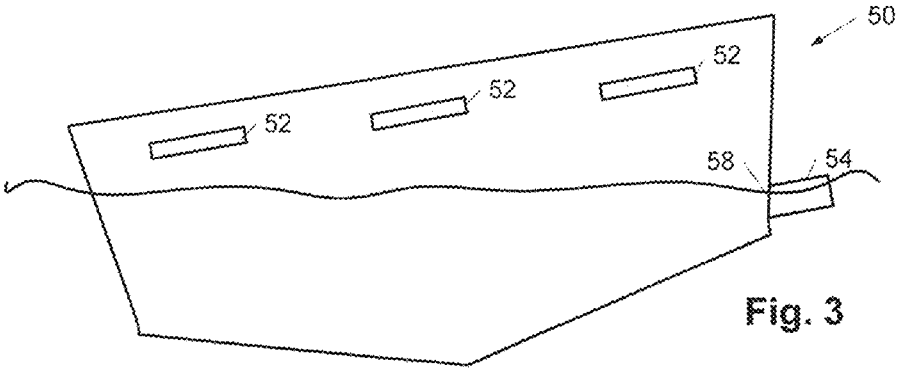
FIG. 3 is a back view of a listed boat with an actuated component extending outward from a sidewall of the boat's hull.

As noted above, actuated components positioned along or within a sidewall of a hull may cause the boat to yaw when the component is moved outward from the sidewall of the hull. In order to facilitate such functionality, the actuated components described herein are positioned along and/or within a sidewall of a hull of a boat such that at least a portion of the actuated component is below a waterplane of the boat when its ballast system is engaged. A depiction of such is shown in FIG. 2 for boat 40, specifically boat 40 having ballast system 42 engaged and having a substantially uniform distribution of weight in the boat such that boat 40 is substantially level in the water. As shown, actuated component 44 is disposed within recess 46 and submerged below waterplane 48. In some cases, an actuated component may be positioned along the sidewall of the hull such that at least a portion of the component is below a waterplane of the boat when the ballast system is engaged to list the boat on an opposing side of the boat. A depiction of such is shown in FIG. 3 for boat 50, specifically boat 50 having ballast system 52 engaged and having weight distributed such that boat 50 is listed to a side opposing the side from which actuated component 54 is extending outward. As shown, actuated component 54 is partially below waterplane 58. In general, boats 40 and 50 may include any of the components and configurations described above for boat 20 in reference to FIG. 1. It is noted that although ballast systems 42 and 52 are shown in FIGS. 2 and 3 with ballasts in the upper portion of the boat, the system may alternatively or additionally include ballasts in lower portions of the boat, including below the denoted waterplanes.

In any case, the size, orientation, surface configuration, shape and angle of a component relative to a hull to cause a boat to yaw may vary tremendously among different boats (i.e., depending on the size and design of the boat). An example distance range the actuated component device is configured to extend the component outward from the sidewall of the hull when it has been deployed may be between approximately 1 inch and approximately 12 inches, but larger extensions of the component from the sidewall of the hull may be considered. In addition, example dimensions for a component may include a width between approximately 1 inch and approximately 3 inches, a length between approximately 4 inches and approximately 12 inches, and a depth of approximately 2 inches and approximately 14 inches. However, larger or smaller dimensions may be considered. As noted above, rectangular and square plates oriented such that the height of the plate extending from its lowermost edge to its uppermost edge is greater than a thickness of the plate extending from its backmost edge (i.e., the edge closest to the stern of the boat) to its frontmost edge (i.e., the edge closest to the bow of the boat) as is shown for component 44 in FIG. 2 were found during the development of the devices disclosed herein to be particularly effective for causing a boat to yaw. In this manner, an actuated component arranged closer to vertical than horizontal may be considered a prudent orientation to cause a boat to yaw.

Figures 4, 5, 6:
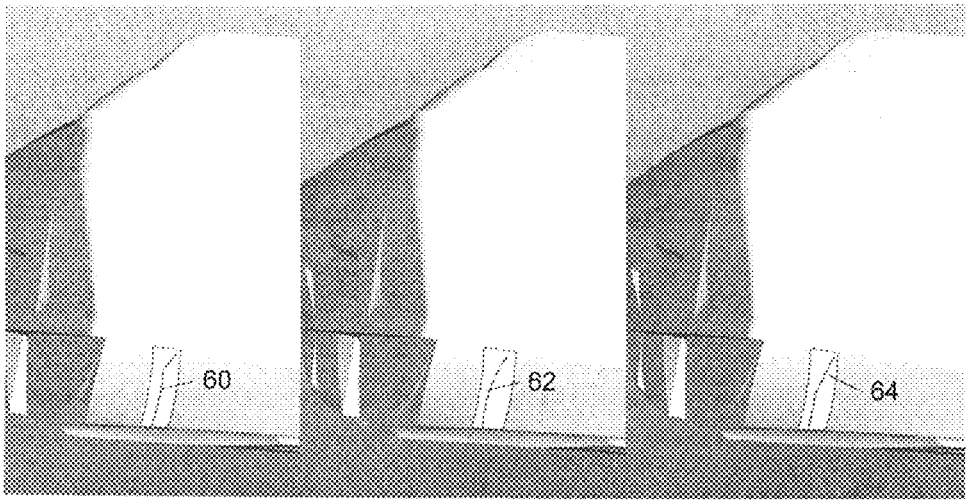
FIGS. 4-6 are perspective side views of backend of boats having respectively different configurations of actuated components positioned within recesses of the hulls' sidewalls.

Although the description and depictions of components in reference to FIGS. 1-3 emphasize a flat plate orientation for actuated components 22, 44 and 54, it is noted that additional or alternative component configurations may be considered for causing a boat to yaw. For example, a component of any shape, including but not limited to a rectangles, triangles, circles, squares, ellipses, or any polygonal shape, may be employed. In addition, a component may be straight, curved, bent, flat and/or include projections and/or depressions to cause a boat to yaw. For example, FIGS. 4-6 illustrate perspective side views of boats having actuated components with plates of respectively different contours. In particular, FIGS. 4 and 6 illustrate bent plates 60 and 64, differing by the location of the bend along the plate. FIG. 5 illustrates a curved plate 62, specifically convex relative to a stern of the boat. Plates with concave curvatures relative to a stern of a boat may be considered as well. In any case, the angle of an actuated component relative to upper, lower and either sideway portions of the hull sidewall when it is extended outward may be any angle between 5° and approximately 85°.

Figure 7:
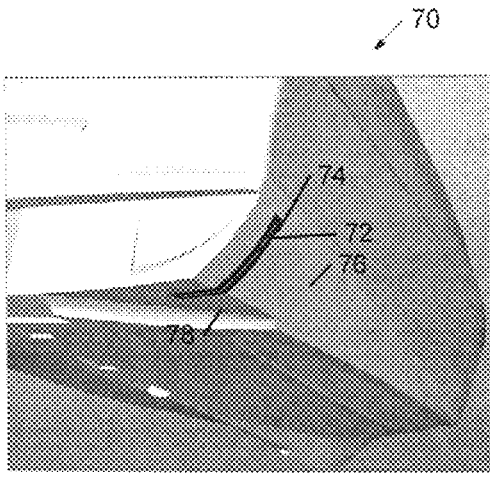
FIG. 7 is a perspective side and bottom view of a boat having an actuated component positioned within a recess of the hull.
Figure 8:
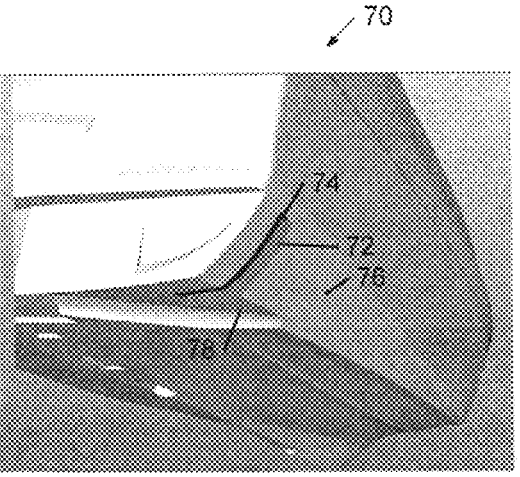
FIG. 8 is a perspective side and bottom view of the boat depicted in FIG. 7 with the actuated component moved outward from the recess.

In some cases, actuated components 22 may be oriented such that a lowermost edge of the component is spaced above a bottom of the hull such as shown for components 44 and 54 in FIGS. 2 and 3. In other embodiments, however, the components may be oriented such that its lowermost edge extends to the bottom of the hull such as shown in FIGS. 4-6. In some of such cases, the component and its associated actuator may be configured such that a portion of the component moves outward under the hull in addition to moving outward from the sidewall of the hull. An example of a component and its associated actuator having such functionality is illustrated in FIGS. 7 and 8, specifically FIG. 7 showing boat 70 having actuated component 72 disposed within recess 74 which extends along sidewall 76 and bottom 78 of the hull and FIG. 8 showing actuated component 72 extending outward from sidewall 76 and below bottom 78. In some cases, a component which extends outward under a hull in addition to extending outward from a sidewall of a hull may be used to lift the boat in addition to causing the boat to yaw. In particular, extending a portion of the component below the hull of the boat may cause the adjacent portion of the boat to lift causing the boat to list to the other side. In such embodiments, the manipulation of wakesurf and wakeboard wakes via the actuated component may be greater and/or more fine-tuned versus actuated components which do not extend below a boat's hull. In some of such cases, an actuated component may be used to supplement an existing listing system within the boat (i.e., a ballast system and/or other types of listing components known in the art). In yet other embodiments, the actuated component and a corresponding device on the other side of the boat may be used as the sole listing system within the boat.

In some embodiments, actuated components 22, 44, 54, 60, 62, 64 and/or 72 may be configured, such as via a second actuator, to move in a longitudinal direction along a sidewall of the hull. In an exemplary arrangement, the second actuator may be recessed within a hull of a boat and coupled to the device to move it as a whole (i.e., the component, the first actuator, and if applicable, housing encasing the component and first actuator). It is contemplated that allowing an actuated panel device to be repositioned in a longitudinal direction along the sidewall of the hull may further aid in manipulating the size and/or shapes of wakes and/or waves generated at the end of the boat. In particular, it is believed the degree of which a boat may be caused to yaw in response to extending an actuated component outward from the sidewall of the hull may vary based on the position of the actuated component along the longitudinal direction of the sidewall, which may in turn be used to manipulate a wakesurf or wakeboard wake generated by the boat. In alternative embodiments, an actuated component may be fixed at a single location along a longitudinal direction of a boat's hull.

As noted above, boats having actuated components coupled to and/or disposed within recesses in the bottom of a boat's hull spaced from a longitudinal axis of the boat are provided. The term "bottom of a hull" as used herein refers to a portion of the hull that is angled more than 45° relative to a vertical axis when the boat is balanced in the water (i.e., the term "bottom of a hull" refers to a portion of the hull that is considered closer to horizontal than vertical when the boat is balanced in the water). As further stated above, components positioned along or within a bottom a boat's hull may generally cause the boat to list when deployed. In some cases, the devices can be configured to lift up a side of the boat. For example, a device may include a hinged plate and an actuator for moving the plate from a position flush or recessed within the boat hull to a position below the boat hull. In some of such embodiments, the plate may be hinged to the running surface of the hull. In other cases, the solid plate may be hinged within a recess in the bottom of the hull. In either embodiment, the plate may be swung down under the boat hull to any number of positions at angles greater than 0° and less than 180° relative to its original position (i.e., its non-deployed position). In yet other cases, the actuator associated with a plate may be coupled to one end of the plate and configured to move the plate such that an opposing distal free end of the plate moves out of a recess holding the plate under the hull.

Yet another alternative design for actuated components coupled to and/or disposed within recesses in the bottom of a boat's hull is to configure them to pull down a side of the boat. For example, a device may include a hydrofoil and an actuator for moving the hydrofoil from a position within the boat hull to a position below the boat hull. In some embodiments, the device may be configured to swing the hydrofoil down below the boat hull similar to the aforementioned description of having a hinged plate along a bottom of a boat's hull. In particular, an edge of the hydrofoil may be either hinged to a running surface of the boat hull or within a recess in the bottom of the boat hull. Similar to the description of the plate discussed above, the device may be configured to move the hydrofoil to any number of positions at angles greater than 0° and less than 180° relative to its original position within the hull (i.e., its non-deployed position). In yet other cases, the device may be configured to lower the hydrofoil below the boat at a fixed angle (such as but not limited to 90°) relative to the hull of the boat. In such cases, the hydrofoil may not have a hinged edge. Rather, the peripheral edges of the hydrofoil are unsecured and the hydrofoil moves in and out of the boat hull at a fixed angle. In general, the distance the device in such cases may be configured to move the hydrofoil relative to its original position within the hull (i.e., its non-deployed position) may depend on the size and design of the boat, particularly taking into consideration safety precautions to prevent the boat from capsizing. An exemplary distance range may be any distance up to approximately 1 foot, but a device may be configured to move a hydrofoil a greater distance.

It is noted that the aforementioned descriptions of devices including a plate or hydrofoil to respectively lift or lower a side of a boat are merely examples of components which may be used to list a boat. Other types and/or configurations of actuated listing components may be used. As such, the term "actuated listing component" as used herein may generally refer to any component which may be included within a device with an actuator to lower and/or lift a side of a boat. The term is inclusive to the descriptions of the plates and hydrofoils discussed above, but may include other component configurations as well. In any case, the size of an actuated listing component may generally depend on the size and design of the boat, particularly taking into consideration safety precautions to prevent the boat from capsizing. An example size range of an actuated listing component is to have dimensions less than approximately 25% the width of the boat, but actuated listing components with larger sizes may be considered. In addition, the length of the actuated listing component may be generally arranged parallel with the stern of the boat or at angle less than 45° relative to the stern of the boat. In cases in which the actuated listing component includes a hinged edge, the hinged edge may be arranged parallel with the stern of the boat or at angle less than 45° relative to the stern of the boat such that the actuated listing component is swung down perpendicular or nearly perpendicular with a running surface of the boat. In cases in which the actuated listing component includes a hydrofoil and it moves in and out of the boat hull at a fixed angle, the length of the hydrofoil may be arranged parallel with the stern of the boat or at angle less than 45° relative to the stern of the boat.

Although a boat may include a single actuated listing component for listing the boat, a boat preferably includes multiple actuated listing components, particularly to enable flexibility to list the boat to either side. In some embodiments, a boat may include at least two actuated listing components, each disposed on either side of a center longitudinal line of the hull. In such cases, the at least two actuated listing components may be both configured to either pull down the side of the boat or lift up the side of the boat. In some of such embodiments, it may be advantageous for the actuated listing components to be the same (e.g., each actuated listing component includes a plate or a hydrofoil). In some additional or alternative cases, a boat may include at least two actuated listing components which are disposed on the same side of a center longitudinal line of the hull. In such cases, it may be advantageous for the at least two actuated listing components to include different types of actuated listing components, particularly one which is configured to pull the side of the boat down and the other configured to lift the side of the boat up.

Regardless of its configuration, an actuated listing component may be arranged in some embodiments such that a bottom surface of the actuated listing component is flush with the running surface of the hull when it has not been deployed (i.e., when it has not been moved down under the boat hull by the actuator). As used herein, the term "flush" refers to being even, level and/or forming the same plane, but does not necessitate surfaces be in contact with each other. As such, the actuated listing components described herein may be spaced apart (or may be designed to be spaced apart) from adjacent portions of boat hulls even when its actuator is in its contracted position. In other embodiments, actuated listing components may make contact with adjacent portions of boat hulls and, in some cases, the actuated listing components may be large enough such that there are no gaps in the running surface when actuated listing component has not been deployed. In yet other cases, an actuated listing component may not be flush with a running surface of a hull when it has not been deployed. Rather, a lowermost surface of an actuated listing component may be recessed within the hull when the component is not deployed. In such cases, a hull or a housing holding the actuated listing component and associated actuator may include a sliding door configured to cover and expose the recessed component in response to user input or based on the deployment of the actuated component. In particular, the sliding plate may be moved to expose the recessed device when requested by a user of the boat, particularly to deploy the actuated listing component. In addition, the sliding plate may be moved to cover the recessed device when requested by the user of the boat and/or the boat exceeds a predetermined speed.

In some cases, an actuator may be configured to move an associated actuated listing component to a single designated position under the hull of the boat. In other embodiments, the actuator may be configured to move the listing component to multiple predetermined positions. In yet other cases, the actuator may be programmed to vary the position of the listing component relative to a variable parameter of the boat, such as but not limited to speed, inclination, and water pressure against the plate. In any case, it is noted that the actuator may be coupled to a controller and, in some embodiments, a user interface of the boat. In particular, the employment/movement of the actuated listing component devices described herein may be automated and, in some cases, activated via a user interface of the boat. In some cases, for safety precautions, the controller of the boat may be programmed to restrict use of the actuator and/or retract the listing component when boat speed exceeds a particular threshold, such as but not limited to 20 mph.

In some embodiments, the actuated listing component devices described herein may be configured, such as via a second actuator, to move in a longitudinal direction along a boat's hull. The second actuator may be recessed within a hull of a boat and coupled to the actuated listing component device to move it as a whole (i.e., the listing component and the first actuator together). In cases in which the actuated listing component device is recessed in the hull, the recess may be relatively large to accommodate the movement along the longitudinal direction of the boat's hull. Thus, the hull may, in some embodiments, include one or more sliding plates configured to automatically cover and expose the recess as needed, particularly along different positions in a longitudinal direction along a boat's hull.

It is contemplated that allowing an actuated listing component device to be repositioned in a longitudinal direction along a boat's hull may aid in manipulating the size and/or shapes of wakes and/or waves generated at the end of the boat. In particular, it is believed positioning an actuated listing component device in close proximity to a stern of a boat (such as but not limited to within approximately 1 foot of the stern) may allow for a change in the flow of the water coming off the bottom of the boat to create a larger wakesurf or wakeboard wake. In addition, it is believed positioning an actuated listing component device farther away from a stern of a boat (such as but not limited to greater than approximately 1 foot of the stern) may allow for water being shaped by the listing component to have time to come back to the running surface and not disrupt the flow of the water coming out of the back of the boat keeping the wake and/or wave clean. In alternative embodiments, the actuated listing component devices described herein may be fixed at a single location along a longitudinal direction of a boat's hull, including locations less than, greater than and at approximately 1 foot from the stern of a boat or even position at the transom.

Figure 9:
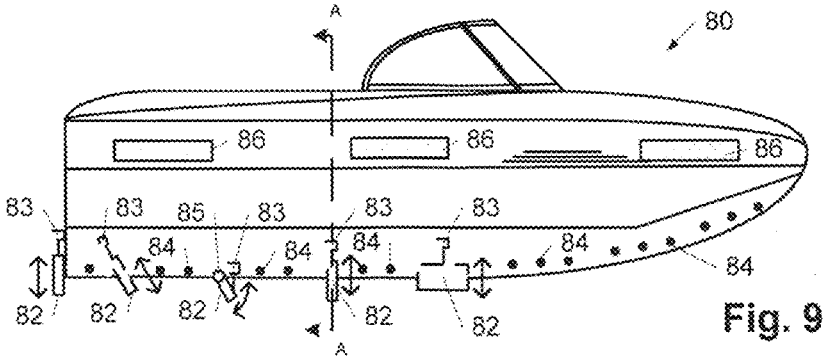
FIG. 9 is a side view of a boat having a variety of different actuated components positioned along or within a bottom of the boat's hull.

FIG. 9 illustrates a side view of boat 80 having a variety of different actuated listing components 82 positioned along or within a bottom of the boat's hull. The variety of different actuated components 82 are shown to depict the varying degree of sizes a component may have, the varying positions a component and an associated actuator may be positioned along or within a boat's hull, and the varying directions of movement of a component relative to the boat's hull. As will be set forth in more detail below, the boats and actuated listing component devices described herein are not limited to the depictions in FIG. 9 or any of the other drawings. Several other configurations of boats and devices may be considered. Furthermore, although a boat may include multiple actuated listing component devices positioned along and/or within the bottom of its hull, the boats described herein are not necessarily so limited. In particular, the boats described herein may include any number of actuated listing component devices along and/or within the bottom of their hulls, including a single actuated listing component device spaced from and on either side of a longitudinal axis of the boat or even a single actuated device along or within the bottom of the hull spaced from a longitudinal axis of the boat. Furthermore, the actuated listing component devices may be located along and/or within any length of the hull's bottom as denoted by the continuation dots 84 in FIG. 9, including at the stern. As such, the boats described herein should not be limited to the placement of actuated listing component components shown in FIG. 9. It is noted continuation dots 84 are merely used to shown that the actuated devices may be positioned along or within any length of the bottom of the hull of a boat and, thus, continuation dots 84 are not part of boat 80.

Moreover, the boats described herein are not necessarily limited to having a particular configuration of an actuated listing component along a particular position of the hull's bottom. Rather, any of the configurations depicted in FIG. 9 as well as those further described herein may be positioned along or within any portion of the hull's bottom. As such, the boats described herein are not limited to the relative locations of listing component configurations along and/or within the bottom of boat 80 depicted in FIG. 9. In some cases, a boat may include an actuated listing component device of the same configuration on each of the port side and the starboard side of the boat. Further to such embodiments, the actuated listing component devices may be positioned in substantially similar locations along the port and starboard sides relative to the stern and the longitudinal axis of the boat. In particular, such configuration and placement symmetry among two actuated listing component devices on either side of the boat may make the manipulation of wakes behind the boat for regular or goofy riders more uniform. Such symmetry, however, is not required and, thus, the type, placement and/or number of actuated listing component devices on either side of a boat may be different.

As shown in FIG. 9, each of actuated components 82 are coupled to a respective actuator 83, wherein the actuator is configured to move an end of the component outward under the hull and retract the end of the component to be in proximity with the bottom of the hull. In some cases, an actuated component device may be pivotally coupled to a bottom surface of the hull by hinge 85. In such embodiments, the associated actuator 83 is coupled to an inward surface of the component (i.e., the surface facing the bottom surface of the hull) between hinge 85 and the end of the component opposing the hinge, including being directly connected to the end of the component opposing the hinge. In some embodiments, an actuated component device may be at least partially disposed within a recess within a bottom of the hull. Such recesses are not shown in FIG. 9 to simplify the drawings, specifically such that the different configurations of actuated component 82 may be emphasized. In such cases, the associated actuator 83 may be hinged within the recess or may be coupled to one end of the component to move an opposing distal free end of the component outward under the hull.

FIG. 9 further illustrates boat 80 including ballast system 86. The ballast system may include a factory ballast system and/or a ballast system added to the boat after manufacture. Furthermore, the ballasts of ballast system 82 may be above and/or below the floor of boat 80, may be arranged at other locations in boat 80 and/or include more or less ballasts than shown in FIG. 9. Although not shown, boat 80 may further include an inboard engine and a control unit such as described in reference to boat 20 of FIG. 1. In addition, boat 80 may be void of a sail mast and a sail for independently propelling the boat.

Figure 10:
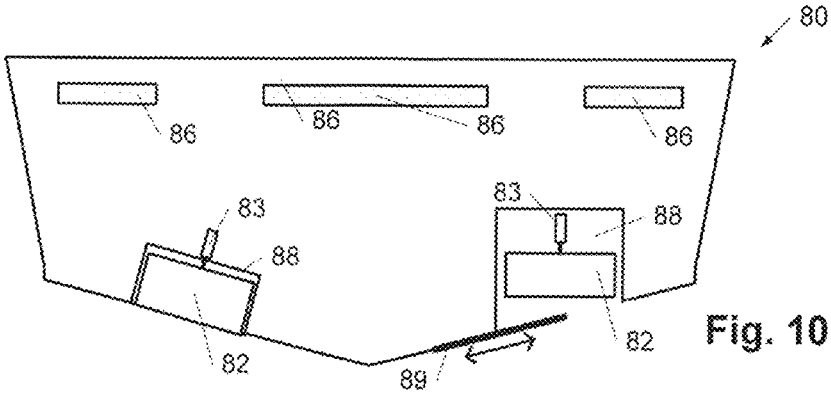
FIG. 10 is a cross-sectional view of the boat depicted in FIG. 9 taken along axis AA depicting two actuated components on either side of a longitudinal axis of the boat incorporated within recesses along the bottom of the hull.

FIG. 10 is a cross-sectional view of boat 80 taken along axis AA of FIG. 9 depicting two actuated listing components 82 on either side and spaced from a longitudinal axis of the boat and incorporated within recesses 88 along the bottom of the hull. As shown, the orientation of actuated listing components 82 may vary. In particular, FIG. 10 illustrates an example in which the lowermost edge of an actuated listing component may be substantially parallel with the bottom surface of the hull (i.e., the listing component shown on the left hand side of FIG. 10) and the associated actuator 83 is configured to move the listing component at the same angle under the hull. In addition, FIG. 10 illustrates an example in which the lowermost edge of an actuated listing component may be substantially parallel with a horizontal axis of boat 80 (i.e., the listing component shown on the right hand side of FIG. 10) and the associated actuator 83 is configured to move the listing component at the same angle under the hull. It is noted that boat 80 need not necessarily include different orientations of actuated listing components 82 on either side of its longitudinal line as illustrated in FIG. 10. Rather, boat 80 may alternatively include actuated listing components of the same type, position and orientation on either side of its longitudinal line. As noted above, such symmetry among two actuated listing component devices on either side of the boat may make the manipulation of wakes behind the boat for regular or goofy riders more uniform. In yet other embodiments, boat 80 may only include actuated listing component/s on one side of the boat.

Figure 11:
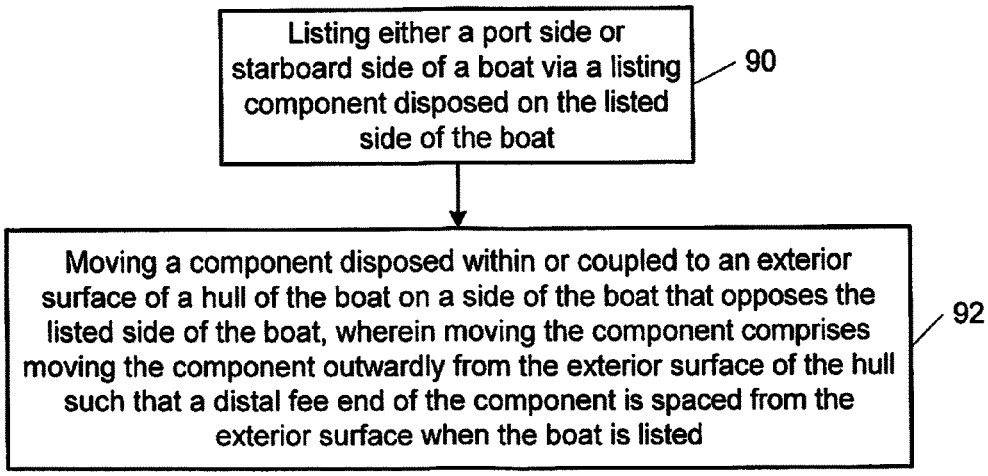
FIG. 11 is a flow chart of a method for creating a wake behind a boat.

As shown in FIG. 11, methods for creating a wake behind a boat are provided. In particular, FIG. 11 shows a flowchart including block 90 in which either a port side or starboard side of a boat is listed via a listing component disposed on the listed side of the boat. The listing component may be any of the actuated listing components described herein which are designed to pull a boat down (e.g., a hydrofoil) or may be part of a ballast system disposed in the boat. The method further includes block 92 for moving a component disposed within or coupled to an exterior surface of a hull of the boat on a side of the boat that opposes the listed side of the boat. The component may include any of the actuated components described herein which are coupled to or disposed within a sidewall of a hull or any of the actuated listing components described herein which are configured to lift a boat up (i.e., a plate).

In either case, the component is moved outwardly from the exterior surface of the hull such that a distal free end of the component is spaced from the exterior surface when the boat is listed. Depending on the location of the component, such movement may be sufficient to cause the boat to yaw and/or enhance the list of the boat. As described above for the actuated components described herein which are coupled to or disposed within a sidewall of a hull or any of the actuated listing components described herein which are configured to lift a boat up, the component may, in some embodiments, be oriented such that a backmost edge of the component is spaced forward from a vertical plane comprising a forward most point of a transom of the boat when the component is moved. In any case, the step of listing the boat in block 90 may, in some embodiments, commence prior to the step of moving the component in block 92. Alternatively, the step of moving the component in block 92 may, in some embodiments, commence prior to the step of listing the boat in block 90. In yet of cases, the steps of listing the boat in block 90 and moving the component in block 92 may commence simultaneously.

Figure 12:
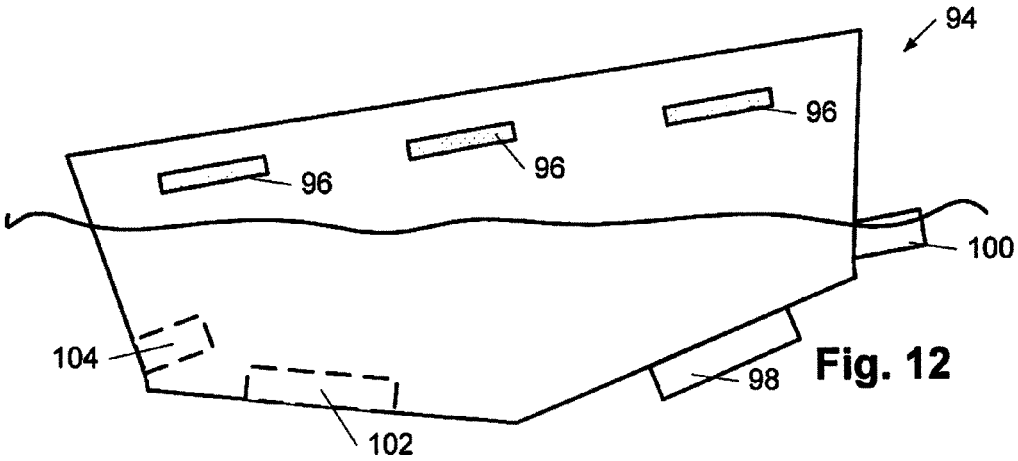
FIG. 12 is a back view of a listed boat with actuated components respectively extending outward from a sidewall of the boat's hull and below the hull on the side of the boat opposing the listed side, wherein the boat includes actuated components recessed within the hull on the listed side of the boat.

FIG. 12 illustrates a back view of boat 94 employing the method outlined in the flow chart of FIG. 11. In particular, FIG. 12 illustrates boat 94 listed on its port side and actuated components 98 and 100 are extended outward from the starboard side of the hull. In some cases, actuated listing component 98 may be extended outward enough to lift the starboard side of the boat and actuated component 100 is extended outward enough to yaw the boat, which in turn may both affect the wake generated at the end of the boat. Furthermore, boat 94 may include actuated components 102 and 104 for respectively lifting the port side of the boat and yawing the boat when the boat is listed to its starboard side. As shown, actuated components 102 and 104 are retracted against or within boat 94 when the boat is listed on its port side. Similarly, actuated components 98 and 100 may be retracted against or within boat 94 when the boat is listed to its starboard side. It is noted one of actuated components 98 and 100 and/or one of actuators 102 and 104 may be omitted from boat 94. Furthermore, boat 94 may additionally or alternatively include an actuated listing component which is configured to pull a side of a boat down (e.g., a hydrofoil), which may aid in listing the boat in addition or alternative to ballast system 96. In some embodiments, boat 94 may include a component configured to both yaw and lift a boat on the side opposing the listed side.

Figure 13:
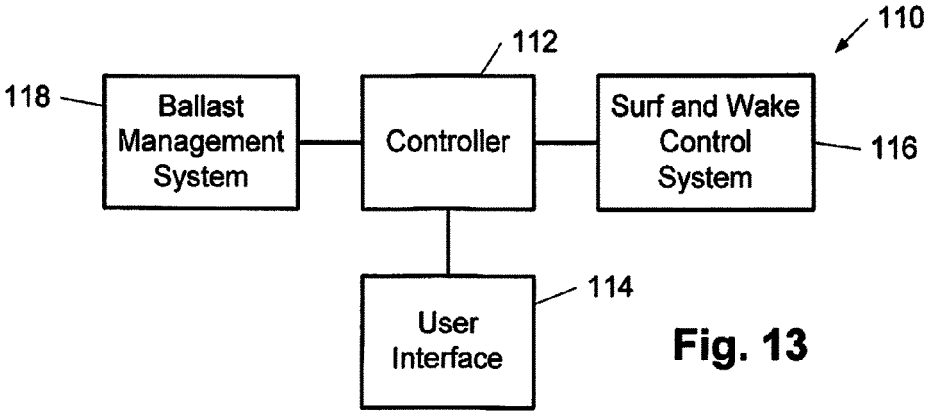
FIG. 13 is a schematic diagram of a control system for a boat.

As noted above, the boats described herein may include a control unit for controlling operations of the boat, including but not limited to the actuated components described herein and the ballast system of the boat. FIG. 13 illustrates a schematic diagram of an example of a control unit which may be employed. In particular, FIG. 13 illustrates control unit 110 including controller 112 electrically coupled to user interface 114, surf and wake control system 116 and ballast management system 118. Controller 112 may include circuitry and/or program instructions for receiving input from user interface 114 to control surf and wake control system 116 and ballast management system 118. Surf and wake control system 116 may be generally configured to control the actuated component devices described herein for causing the boat to yaw and/or list a boat. Ballast management system 118 may generally be configured to control the ballast system of the boat to either uniformly weight the boat down or list the boat to port side or starboard side. Alternative or in additional to controlling such systems in response input at user interface 114, controller 112 may control surf and wake control system 116 and ballast management system 118 based on parameters of the boat monitored by sensors of the boat which are in electrical communication with controller 112. Examples of parameters which may be used to control such systems include but are not limited to speed, inclination, water pressure against an actuated component and/or weight distribution in the boat.

It will be appreciated to those skilled in the art having the benefit of this disclosure that this invention is believed to provide hull mounted devices for yawing and listing boats, particularly for manipulating wakesurf and wakeboard wakes. Further modifications and alternative embodiments of various aspects of the invention will be apparent to those skilled in the art in view of this description. For example, although a plate configuration is emphasized for the actuated components described herein, other component configurations may be considered for inducing the functionality of yawing a listing a boat. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number.

What is claimed is:

1. A boat, comprising:

an inboard engine, wherein the boat is void of a sail mast and a sail for independently propelling the boat;

a recess disposed within a sidewall and along a bottom of a hull of the boat, wherein the recess is spaced from a center longitudinal axis of the boat and spaced at least 6 inches from a transom of the boat;

a component disposed within the recess in the sidewall and the bottom of the hull of the boat; and an actuator coupled to the component for:

extending an end of the component outward from the recess, such that the end of the component extends outward from the sidewall of the hull to yaw the boat and extends downward from the bottom of the hull to list the boat; and retracting the end of the component within the recess so that the end of the component is disposed entirely within the recess.

2. The boat of claim 1, wherein the component is a plate oriented such that a height of the plate extending from its lowermost edge to its uppermost edge is greater than a thickness of the plate extending from its backmost edge to its frontmost edge.

3. The boat of claim 1, wherein the component is a substantially flat plate.

4. The boat of claim 1, wherein the component is a plate having a curved contour or a bend near the end of the component.

5. The boat of claim 1, wherein the recess is spaced at least 12 inches from the transom of the boat.

6. The boat of claim 1, further comprising a ballast system, which when engaged, is configured to weight a stern of the boat, so as to list the boat to one side or the other for producing a wake suitable for wakesurfing or wakeboarding on the listed side.

7. The boat of claim 6, wherein the component is positioned along the sidewall of the hull such that at least a portion of the component is below a waterplane of the boat when the ballast system is engaged to list the boat on a side opposing the sidewall.

8. The boat of claim 1, wherein the component is disposed within the recess and arranged along the starboard side of the boat, and wherein the boat further comprises:

an additional recess disposed within a port side sidewall and along the bottom of the hull, wherein the additional recess is spaced from the center longitudinal axis of the boat and spaced at least 6 inches from the transom of the boat;

an additional component disposed within the additional recess in the port side sidewall and the bottom of the hull; and an additional actuator coupled to the additional component for:

extending an end of the additional component outward from the additional recess, such that the end of the additional component extends outward from the port side sidewall to yaw the boat and extends downward from the bottom of the hull to list the boat; and retracting the end of the additional component within the additional recess so that the end of the additional component is disposed entirely within the additional recess.

9. The boat of claim 1, wherein a backmost surface of the component is spaced forward of a vertical plane of the transom by at least approximately 6 inches when the end of the component is extended outward and downward the recess.

10. The boat of claim 1, wherein the actuator is configured for extending the end of the component from the recess at an angle between approximately 5° and approximately 85° from the sidewall of the hull.

11. The boat of claim 1, further comprising:

a user interface; and a controller electronically coupled between the user interface and the actuator to manipulate movement of the actuator based on input from the user interface.

12. A method for creating a wake behind a boat, comprising:

listing either a port side or starboard side of a boat via a listing component disposed on the listed side of the boat, so as to create a wake suitable for wakesurfing or wakeboarding on the listed side; and moving a component disposed within a recess arranged within a sidewall and along a bottom of a hull of the boat on a side of the boat that opposes the listed side of the boat, wherein the recess is spaced from a center longitudinal axis of the boat, and wherein said moving the component comprises moving the component outwardly from the recess such that a distal free end of the component is extends outward from the sidewall and downward from the bottom of the hull when the boat is listed, and wherein the component is oriented such that a backmost edge of the component is spaced forward from a vertical plane comprising a transom of the boat by at least 6 inches when the distal free end of the component is moved outward and downward from the recess.

13. The method of claim 12, wherein said moving the component comprises moving the component to a position to yaw the boat while the boat is listed via the listing component.

14. The method of claim 12, wherein said moving the component comprises moving the component to a position to lift the side of the boat that opposes the listed side of the boat.

15. The method of claim 12, wherein the component is disposed at least partially within the recess in the sidewall and the bottom of the hull prior to the step of moving.

16. The method of claim 12, wherein the step of moving the component commences prior to the step of listing.

17. The method of claim 12, wherein the step of listing commences prior to the step of moving the component.

18. The method of claim 12, wherein the steps of listing and moving the component commence simultaneously.

19. The method of claim 12, wherein the component is a plate.

* * * * *